US010400401B1

(12) United States Patent
Diserio

(10) Patent No.: US 10,400,401 B1
(45) Date of Patent: Sep. 3, 2019

(54) SIDE SECTION FOR GANGPLANK STRUCTURE

(71) Applicant: Lucas Diserio, Wellsburg, WV (US)

(72) Inventor: Lucas Diserio, Wellsburg, WV (US)

(73) Assignee: American Muscle Docks & Fabrication LLC, Wellsburg, WV (US)

( * ) Notice: Subject to any disclaimer, the term of this patent is extended or adjusted under 35 U.S.C. 154(b) by 0 days.

(21) Appl. No.: 15/912,958

(22) Filed: Mar. 6, 2018

Related U.S. Application Data

(60) Provisional application No. 62/468,336, filed on Mar. 7, 2017.

(51) Int. Cl.

| | |
|---|---|
| ***E01D 19/00*** | (2006.01) |
| ***E01D 2/00*** | (2006.01) |
| ***B63B 27/14*** | (2006.01) |
| ***E01D 19/10*** | (2006.01) |
| *E01D 101/34* | (2006.01) |

(52) U.S. Cl.
CPC ..... *E01D 2/00* (2013.01); *B63B 27/14* (2013.01); *E01D 19/103* (2013.01); *E01D 2101/34* (2013.01)

(58) Field of Classification Search
CPC ..... B63B 27/14; E01D 2/00; E01D 19/103; E01D 2101/34
USPC ..... 14/2.6, 27, 69.5
See application file for complete search history.

(56) References Cited

U.S. PATENT DOCUMENTS

| | | | | |
|---|---|---|---|---|
| 3,504,389 | A * | 4/1970 | Longbottom | E01D 15/133 14/13 |
| 3,834,104 | A * | 9/1974 | Dunn | E04D 13/155 52/376 |
| 4,133,067 | A | 1/1979 | Bennett et al. | |
| 4,590,634 | A * | 5/1986 | Williams | E01D 15/24 114/230.1 |
| 5,224,437 | A | 7/1993 | Stanescu | |
| 5,794,400 | A * | 8/1998 | Fisher | E04F 10/02 156/294 |
| 7,103,935 | B2 | 9/2006 | Hill | |
| 7,444,954 | B1 | 11/2008 | Resta | |
| 8,127,388 | B2 | 3/2012 | Watchorn | |
| 9,567,759 | B2 | 2/2017 | Mizell et al. | |
| 2006/0029470 | A1 * | 2/2006 | Berlin | E02B 3/06 405/4 |

* cited by examiner

*Primary Examiner* — Raymond W Addie
(74) *Attorney, Agent, or Firm* — Alvin T. Rockhill

(57) ABSTRACT

This invention is an improved side section for a marine gangplank/gangway structure. This side section has a unique visually appealing design and provides gangplanks with resistance to twisting and increased live load capacity. The side sections of this invention can be used to reduce the weight and cost of gangplanks while improving durability. This marine structure comprises (1) a horizontal base section, (2) a vertical base, (3) a horizontal spacer, (4) a sigma spring section which extends upwardly from the inside end of the horizontal spacer in a circumferential manner, (5) a lower deck support, wherein the lower deck support extends horizontally from the top end of the sigma spring section, and wherein the lower deck support includes a fulcrum which is situated on the top of the lower deck support, (6) a vertical deck support, and (7) an upper deck.

20 Claims, 10 Drawing Sheets

SIDE SECTION FOR GANGPLANK STRUCTURE

This application claims benefit of U.S. Provisional Patent Application Ser. No. 62/468,336, filed on Mar. 7, 2017. The teachings of U.S. Provisional Patent Application Ser. No. 62/468,336 are incorporated herein by reference in their entirety.

FIELD OF THE INVENTION

This invention relates to a side section for a gangplank/gangway structure. This side section has a unique visually appealing design and provides gangplanks with resistance to twisting and increased live load capacity. The side sections of this invention can be used to reduce the weight and cost of gangplanks while improving durability.

BACKGROUND OF THE INVENTION

Gangplanks, docks, swim platforms, or other similar structures must be reliable, durable, safe, and are preferably aesthetically pleasing. Because gangplanks, piers and docks are generally built to facilitate the transportation of goods and persons over water or wetlands it is critical for such structures to be stable, durable, and to have the structural integrity needed to for their intended purpose, such as providing a passageway for moving people and cargo over water. In any case, reliability is frequently of critical importance in allowing for people and cargo to be moved over open water. It is also critical that such structures be durable against damage from repetitive and continuous use as well as damage from the elements. These structures are almost always installed outdoors and accordingly can be exposed to a multitude of weather conditions over extended periods of time.

Deterioration occurs more rapidly when gangplanks, docks, piers, swim platforms and the like become submerged underwater because they are more susceptible to widespread invasion by aquatic life, damage from debris, and corrosion from prolonged exposure to water (i.e. rust). Therefore, in many applications it is important that gangplanks, docks, piers, and swim platforms have the ability to rise and fall to meet changes in water level, so that these structures are not held under water at periods of time when the water level might overflow the top of the structure.

It can be necessary to remove docks, piers, swim platforms, and gang planks in order to protect them from seasonal changes (i.e. freezing water). It may also be desirable to remove or disassemble any of these structures for cleaning, repair, or during periods of non-use. For this reason, it is advantageous for such structures to be relatively light in weight and to be capable of being taken apart and reassembled easily.

A gangplank typically has side sections which extend laterally along both sides of its sides to support the deck (walking surface) of the gangplank. The deck of the gangplank is a horizontal generally flat surface which is typically comprised of a series of planks which extend between the side sections of the gangplank to form the walking surface. In any case, the deck of conventional gangplanks is supported by side sections. It is important for these side sections to be reliable, durable, strong, stable, safe, and to preferably be aesthetically pleasing. The side sections should also preferably be light in weight and of reasonable cost. There is currently a need for an improved gangplank side section that possesses all of these desirable characteristics.

SUMMARY OF THE INVENTION

The marine gangplank/gangway side sections of this invention are uniquely designed to be reliable, durable, strong, stable, safe, and are aesthetically pleasing. The gangplank side sections of this invention are also light in weight which makes them easy to transport and to assemble into gangplank structures. They are also highly resistant to twisting during use even under high loads and can be manufactured at a reasonable cost with a minimal amount of raw materials. The gangplank side sections of this invention are primarily for use in the assembly of gangplanks. However, they can also be beneficially used in making a variety of dock structures, including stationary docks, floating docks, and swim platforms.

The present invention more specifically discloses a side section for a gangplank structure which is comprised of (1) a horizontal base section having an outside end and an inside end, (2) a vertical base section having a top end and a bottom end, wherein the vertical base section extends upwardly from the outside end of the horizontal base section, (3) a horizontal spacer having an outside end and an inside end, wherein the horizontal spacer extends inwardly from the top end of the vertical base section, (4) a sigma spring section which extends upwardly from the inside end of the horizontal spacer in a circumferential manner, (5) a lower deck support having an outside end and an inside end, wherein the lower deck support extends horizontally from the top end of the sigma spring section, and wherein the lower deck support includes a fulcrum which is situated on the top of the lower deck support at a point which is opposite to the point where the lower deck support extends from the sigma spring section, (6) a vertical deck support having a deck engagement section and an outer flange section, wherein the vertical deck support extends from the lower deck support at a point where the deck engagement section meets the outer flange section, and (7) an upper deck support having a cut-away section which extends from the vertical deck support toward the outside of the upper deck support.

The present invention further reveals a deck structure which is comprised of a first side section, a second side section, end sections, and one or more deck sections, wherein the deck sections extend from the first side section to the second side section to form the deck structure, and wherein the side sections are comprised of (1) a horizontal base section having an outside end and an inside end, (2) a vertical base section having a top end and a bottom end, wherein the vertical base section extends upwardly from the outside end of the horizontal base section, (3) a horizontal spacer having an outside end and an inside end, wherein the horizontal spacer extends inwardly from the top end of the vertical base section, (4) a sigma spring section which extends upwardly from the inside end of the horizontal spacer in a circumferential manner, (5) a lower deck support having an outside end and an inside end, wherein the lower deck support extends horizontally from the top end of the sigma spring section, and wherein the lower deck support includes a fulcrum which is situated on the top of the lower deck support at a point which is opposite to the point where the lower deck support extends from the sigma spring section, (6) a vertical deck support having a deck engagement section and an outer flange section, wherein the vertical deck support extends from the lower deck support at a point where the deck engagement section meets the outer flange section, and (7) an upper deck support having a cut-away section which extends from the vertical deck support toward the outside of the upper deck support.

BRIEF DESCRIPTIONS OF THE DRAWINGS

Figure 1:
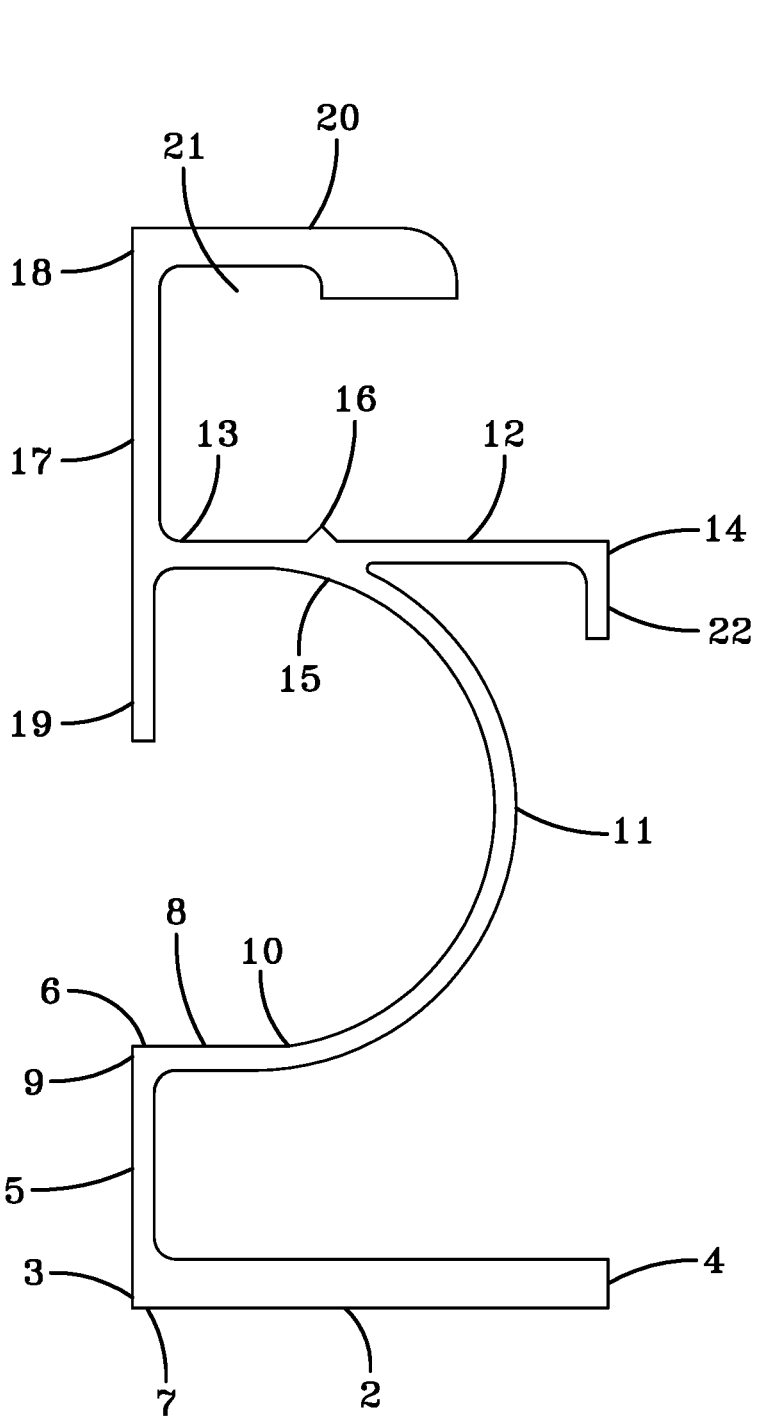
FIG. 1 is an end view of the gangplank side section of this invention.

The drawings include certain reference numerals which correspond to the following items:

1—gangplank side section
2—horizontal base section
3—outside end of horizontal base section
4—inside end of horizontal base section
5—vertical base section
6—top end of vertical base section
7—bottom end of vertical base section
8—horizontal spacer
9—outside end of horizontal spacer
10—inside end of horizontal spacer
11—sigma spring section
12—lower deck support
13—outside end of lower deck support
14—inside end of lower deck support
15—top end of sigma spring section
16—fulcrum
17—vertical deck support
18—deck engagement section of vertical deck support
19—outer flange section of vertical deck support
20—upper deck support
21—cut away section of upper deck support
22—return flange
23—gangplank
24—deck
25—first gangplank side section
26—second gangplank side section
27—handrail

DETAILED DESCRIPTIONS OF THE INVENTION

Figure 5:
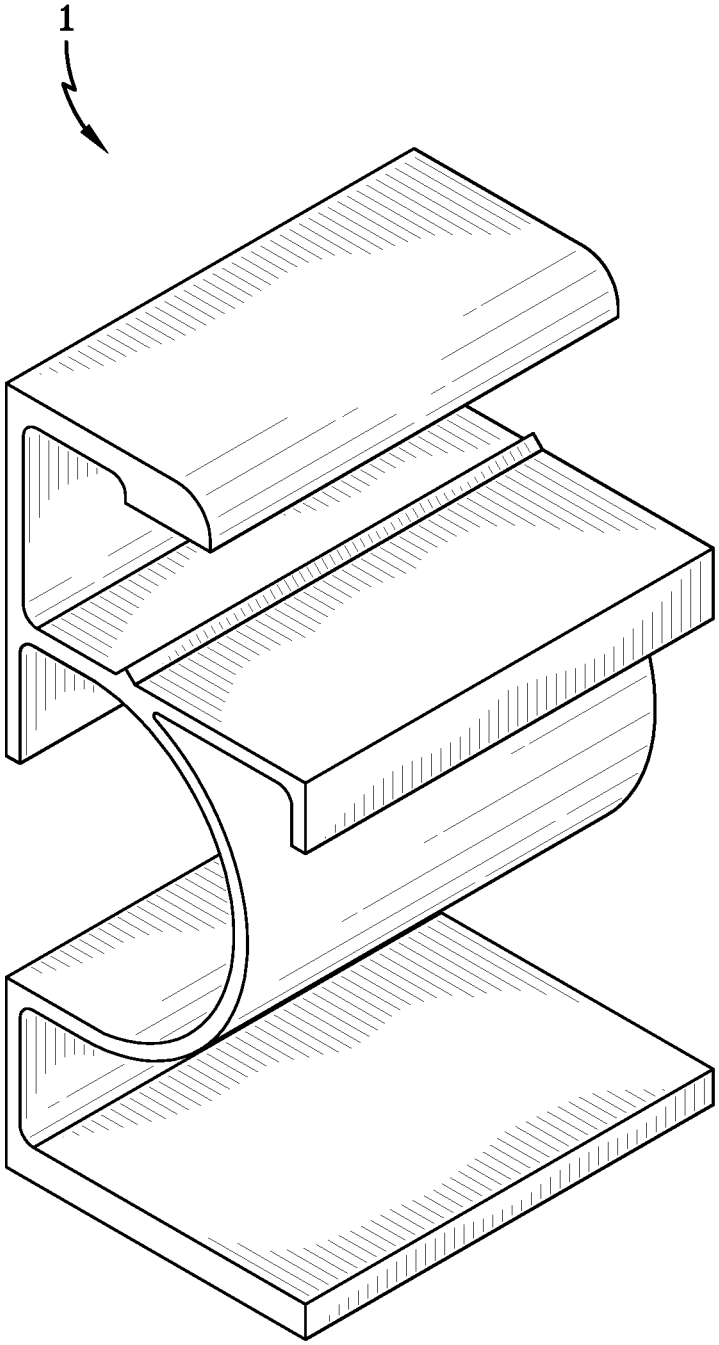
FIG. 5 is a perspective view of a gangplank side section of this invention.
Figure 6:
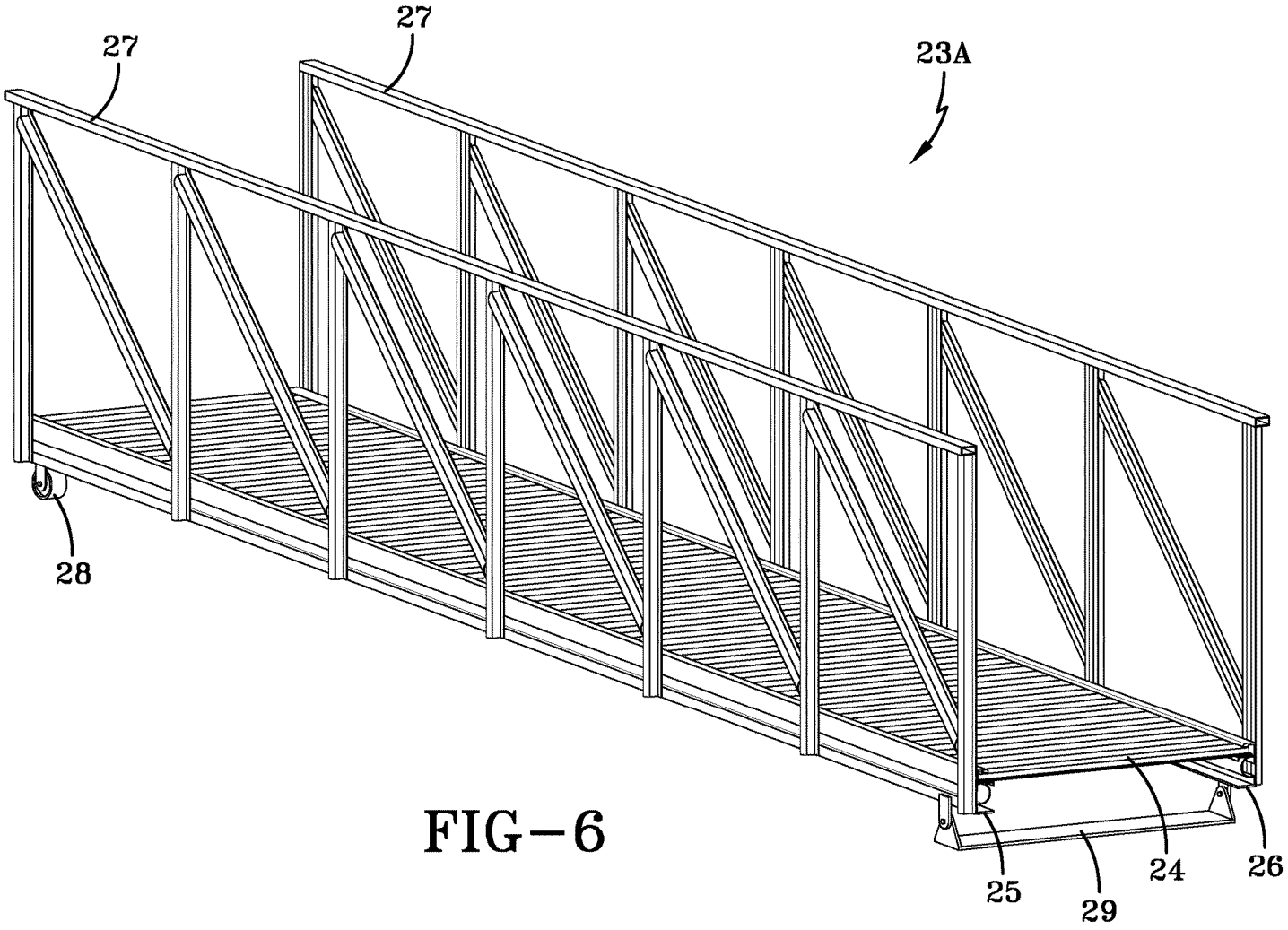
FIG. 6 illustrates a deck structure with a hinge at one end and a roller at the other end thereof.
Figure 7:
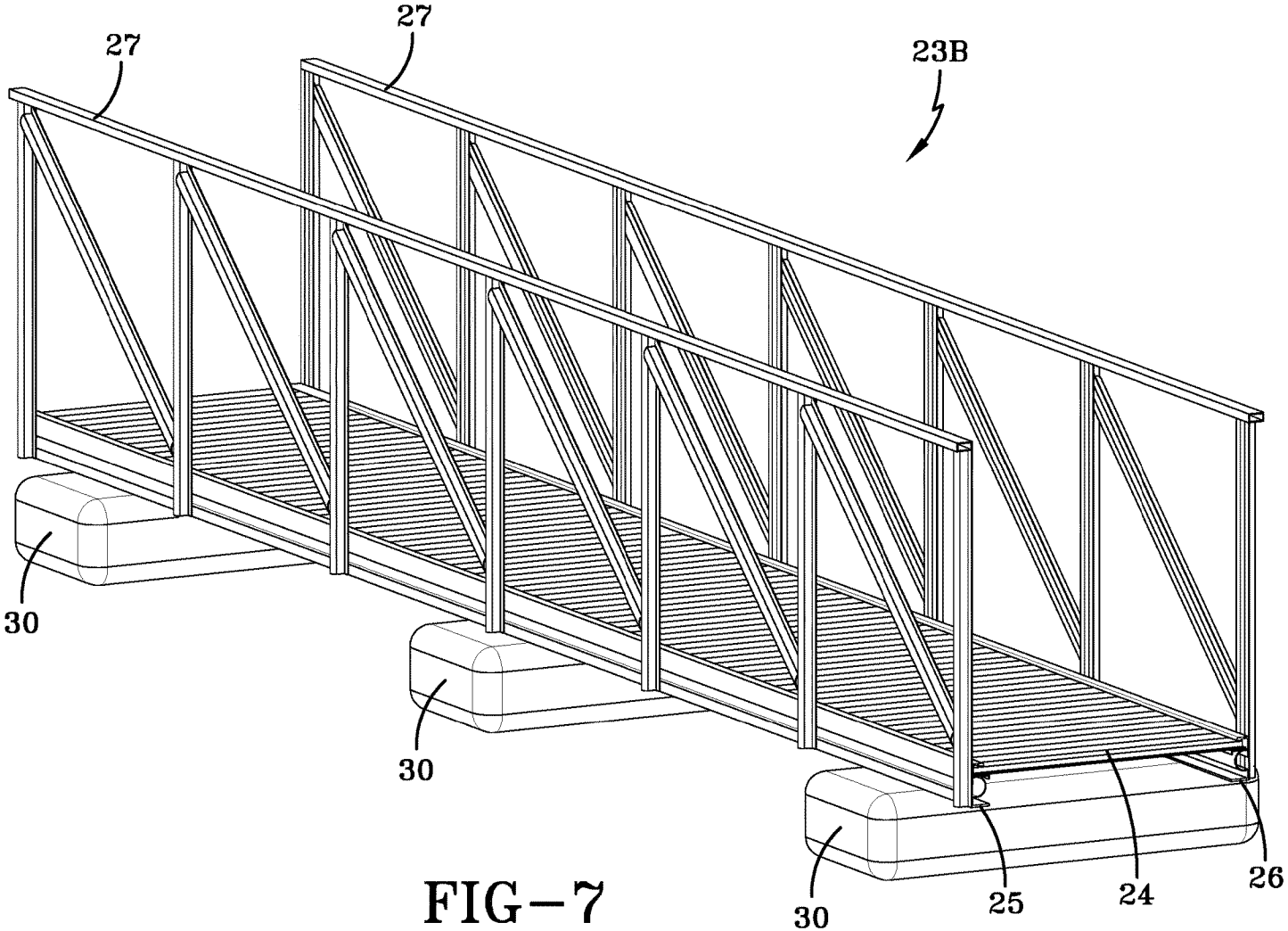
FIG. 7 shows a deck structure wherein the horizontal base section is affixed to float drums on the bottom side thereof.
Figure 8:
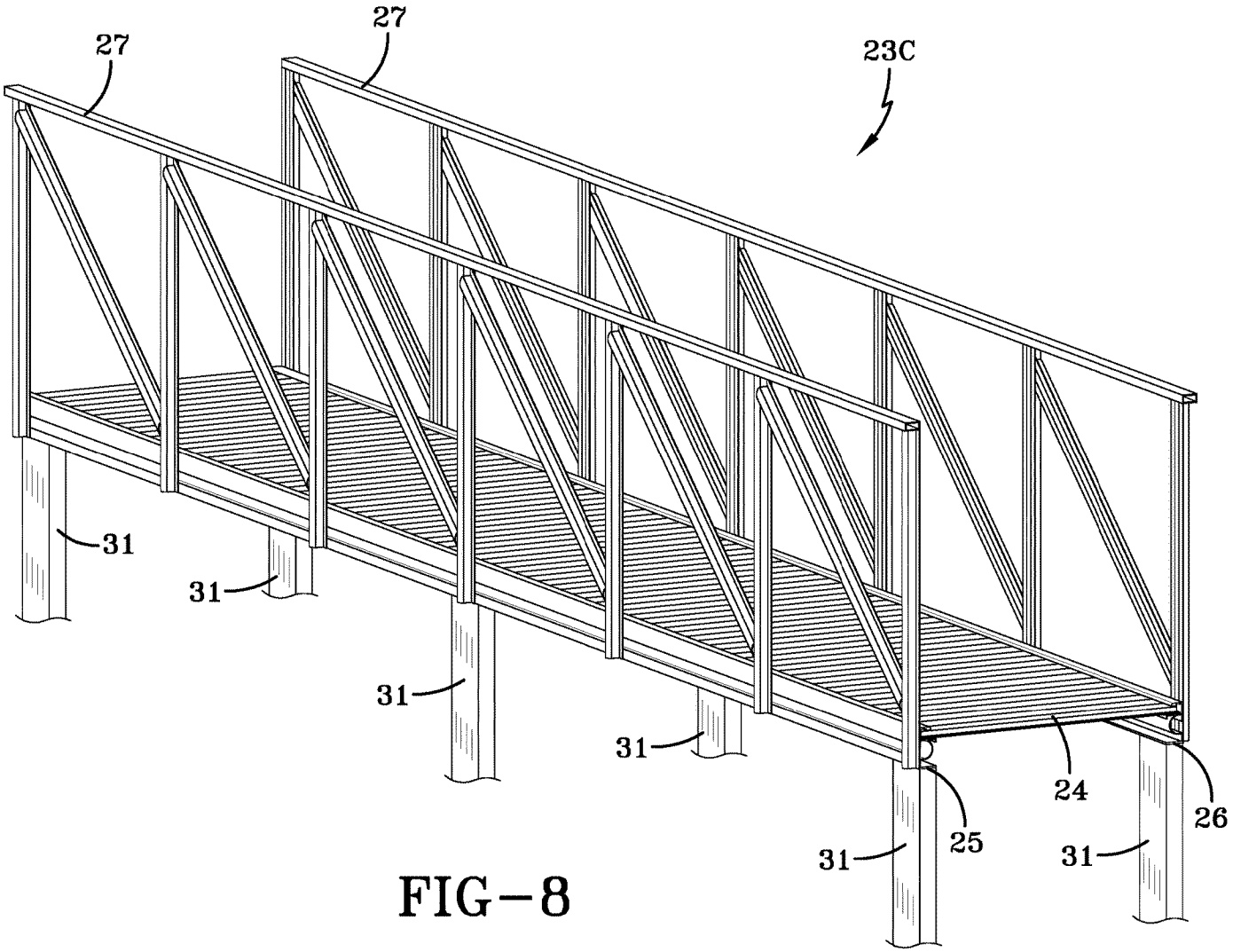
FIG. 8 illustrates a deck structure which is a stationary dock wherein the horizontal base section is affixed to anchoring poles.
Figure 9:
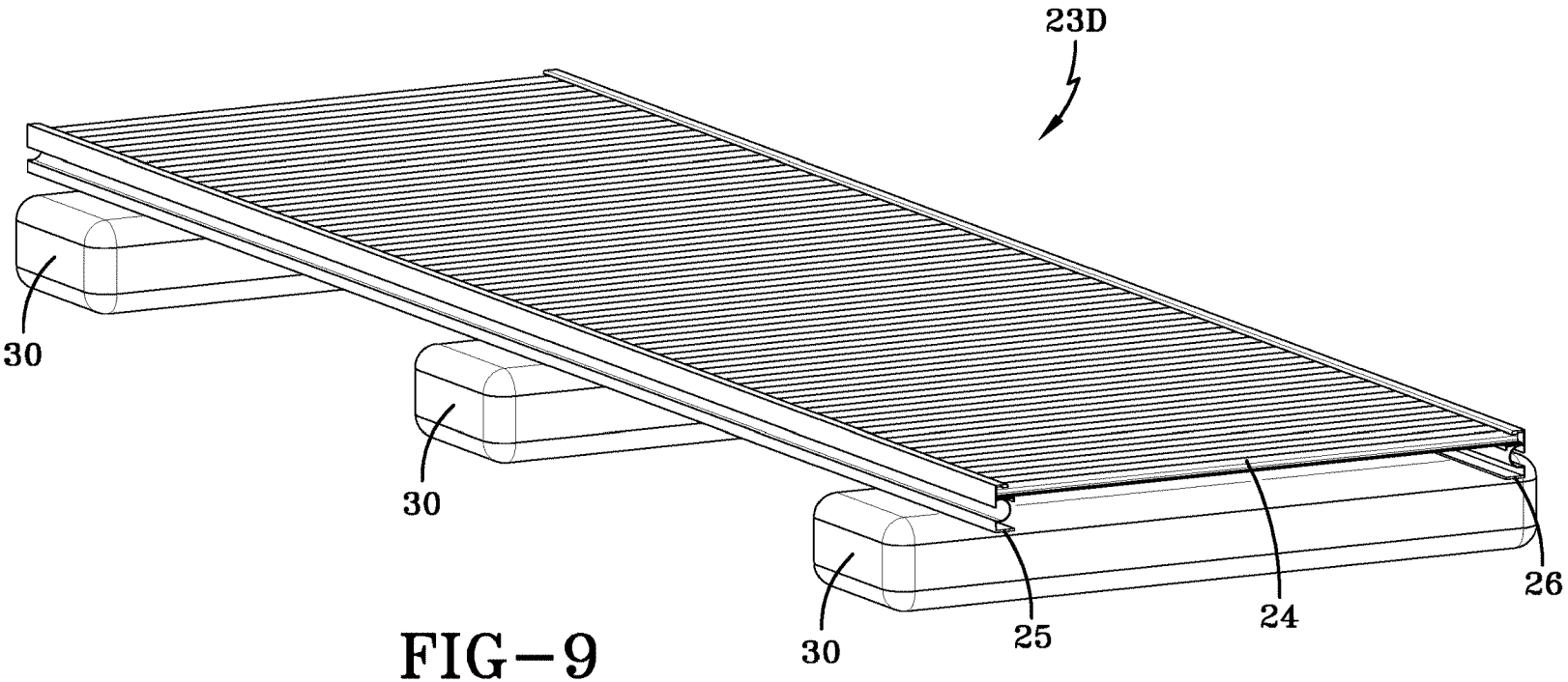
FIG. 9 shows a deck structure in the form of a swim platform wherein the horizontal base section is affixed to float drums on the bottom side thereof.
Figure 10:
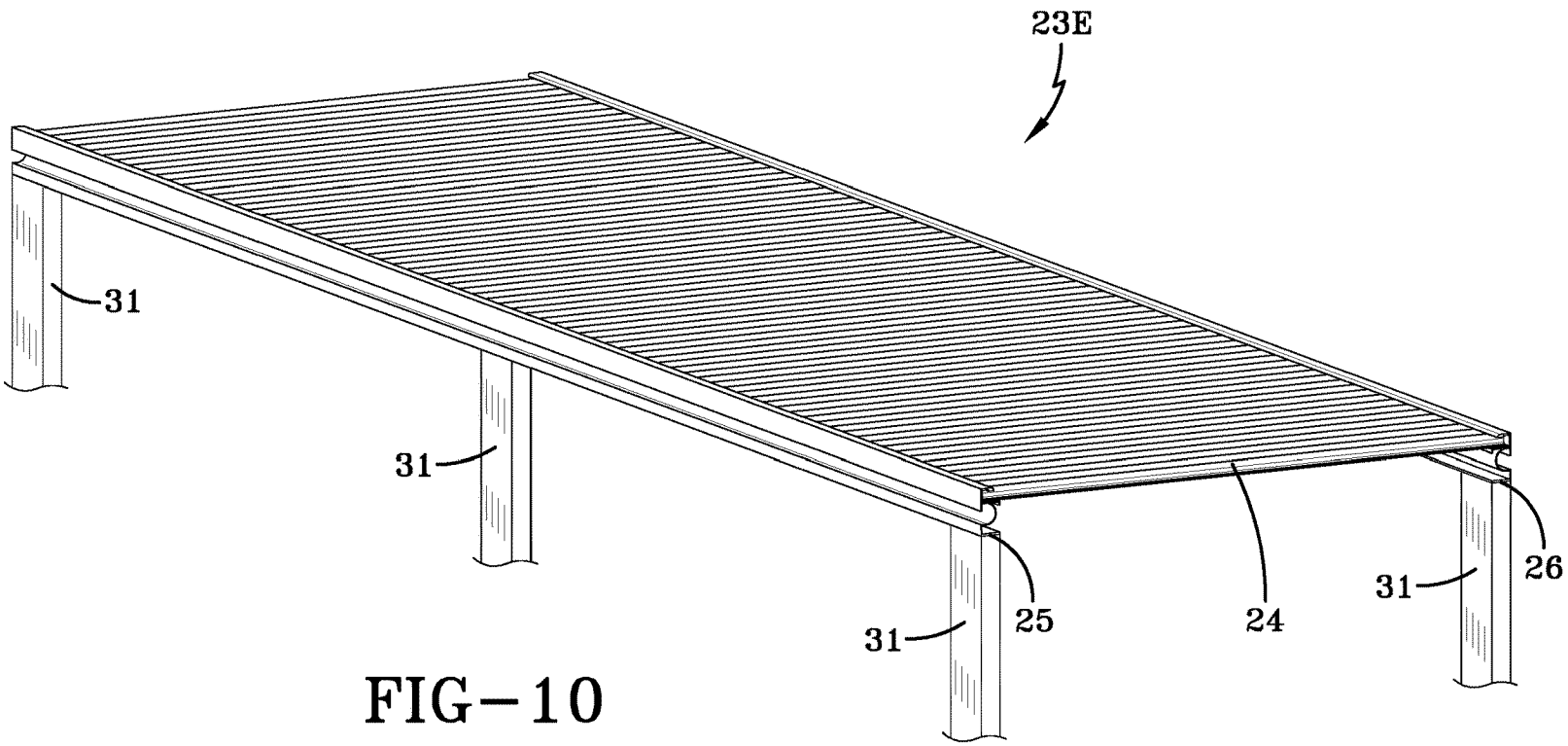
FIG. 10 shows a deck structure in the form of a swim platform wherein the horizontal base section is affixed to anchoring poles.

A gangplank side section 1 of this invention is illustrated in FIG. 1 and in FIG. 5. As can be seen this structure is comprised of (1) a horizontal base section 2 having an outside end 3 and an inside end 4, (2) a vertical base section 5 having a top end 6 and a bottom end 7, wherein the vertical base section extends upwardly from the outside end 3 of the horizontal base section 2, (3) a horizontal spacer 8 having an outside end 9 and an inside end 10, wherein the horizontal spacer extends inwardly from the top end 6 of the vertical base section 5, (4) a sigma spring section 11 which extends upwardly from the inside end 10 of the horizontal spacer 8 in a circumferential manner, (5) a lower deck support 12 having an outside end 13 and an inside end 14, wherein the lower deck support 12 extends horizontally from the top end 15 of the sigma spring section 11, and wherein the lower deck support 12 includes a fulcrum 16 which is situated on the top of the lower deck support 12 at a point which is opposite to the point where the lower deck support 12 extends from the sigma spring section 11, (6) a vertical deck support 17 having a deck engagement section 18 and an outer flange section 19, wherein the vertical deck support 17 extends from the lower deck support 12 at a point where the deck engagement section 18 meets the outer flange section 19, and (7) an upper deck support 20 having a cut-away section 21 which extends from the vertical deck support 17 toward the outside of the upper deck support 20. The cut-away section 21 of the upper deck support 20 allows the decking to float inside the side sections 1 which reduces stress and makes the gangway less susceptible to twisting. The fulcrum 16 of the lower deck support 12 is designed to center the load (vertically) through the side sections which also reduces stress and makes the gangway less susceptible to twisting.

The gangplank side section 1 will also preferably include a return flange 22 which extends downwardly and at a right angle to the inside end 14 of the lower deck support 12. The gangplank side section will preferably be comprised of aluminum, such as 6063-T5 aluminum. In any case, the material will typically have a yield strength of at least 21,000 psi at a temperature of 150° F.

FIG. 1 and FIG. 5 are drawn to scale to illustrate the approximate dimensions of a gangplank side section 1 in a preferred embodiment of this invention. In this embodiment the gangplank side section 1 will have a total height of about 5 inches as measured from the bottom of the horizontal base section 2 to the top of the upper deck support 20. As can be seen the horizontal base section 2 and the lower deck support 12 are of the same approximate length. In one embodiment of this invention the horizontal base section 2 has a length of about 2.2 inches (as measured from the outside end of horizontal base section 3 to the inside end of horizontal base section 4). In such an embodiment, the sigma spring section 11 extends upwardly from the top end of vertical base section 6 to the lower deck support 12 a distance with is also the approximate length of the horizontal base section 2 and with normally be within ±25% and preferably within ±10% of the length of the horizontal base section 2. In such an embodiment the outer flange section of vertical deck support 19 and the vertical base section 5 will extend a distance which is within the range of about 20% to about 50% of the length of the horizontal base section 2 and which is preferably within the range of about 30% to about 45% of the length of the horizontal base section 2.

The fulcrum 16 will normally be situated on the lower deck support 12 at a point which is situated about 25% to 45% of the distance from the outside end of lower deck support 13 to the inside end of lower deck support 14. The fulcrum 16 will more typically be situated on the lower deck support 12 at a point which is situated about 30% to 40% of the distance from the outside end of lower deck support 13 to the inside end of lower deck support 14. It is generally preferred for the fulcrum 16 to be situated on the lower deck support 12 at a point which is situated about 32% to 36% of the distance from the outside end of lower deck support 13 to the inside end of lower deck support 14. The return flange 22 will typically extend downwardly from the lower deck support 12 a distance with is within the range of 10% to 40% of the height of the vertical base section 5 and will generally extend downwardly from the lower deck support 12 a distance with is within the range of 15% to 25% of the height of the vertical base section 5. The vertical deck support 17 will typically have a height which is within the range of 40% to 80% of the length of the horizontal base section 2 and will more typically have a height which is within the range of 30% to 70% of the length of the horizontal base section 2.

Figure 2:
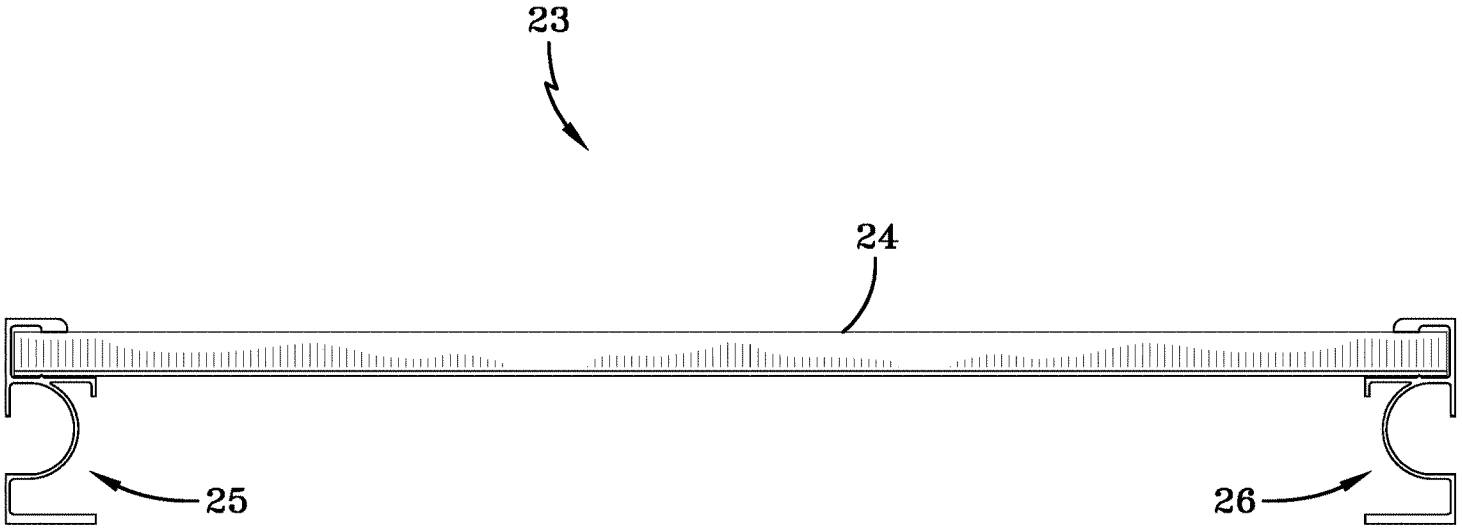
FIG. 2 is an end view of a gangplank of this invention.

The deck engagement section 18, the lower deck support 12, and the upper deck support 20 will adapted to holding deck sections of gangplanks and other deck structures, such as stationary docks, floating docks, and swim platforms, securely in place. The fulcrum 16 will be designed to hold the weight of the deck structure of a gangplank 23 which will extend between two side sections as illustrated in FIG. 2. As can be seen in FIG. 2 the deck 24 of the gangplank 23 extends from a first gangplank side section 25 to a second gangplank side section 26 on the opposite side of the deck 24.

The deck structure will also include ends sections having the same profile as that of the side sections. The end sections extend at essentially a right angle to the side sections. In the case of gangways one end section will have one or more hinges attached thereto which allow the gangway structure to be secured to land with the other end having rollers to allow movement onto another structure, such as a ship. In another embodiment of this invention both ends of the gangway structure can have hinges attached thereto (without rollers being on either end).

Figure 3:
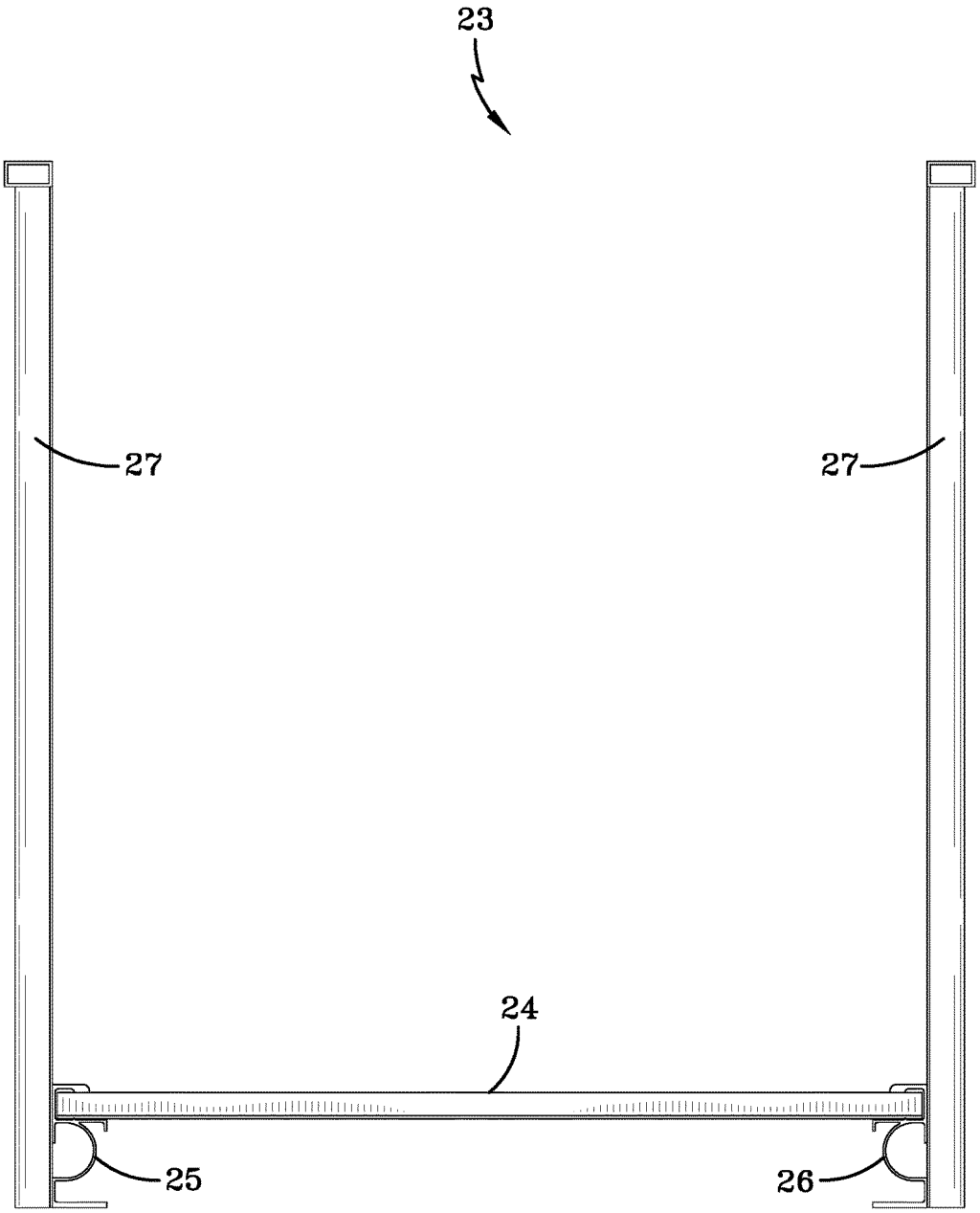
FIG. 3 is an end view of a gangplank of this invention which is equipped with handrails.
Figure 4:
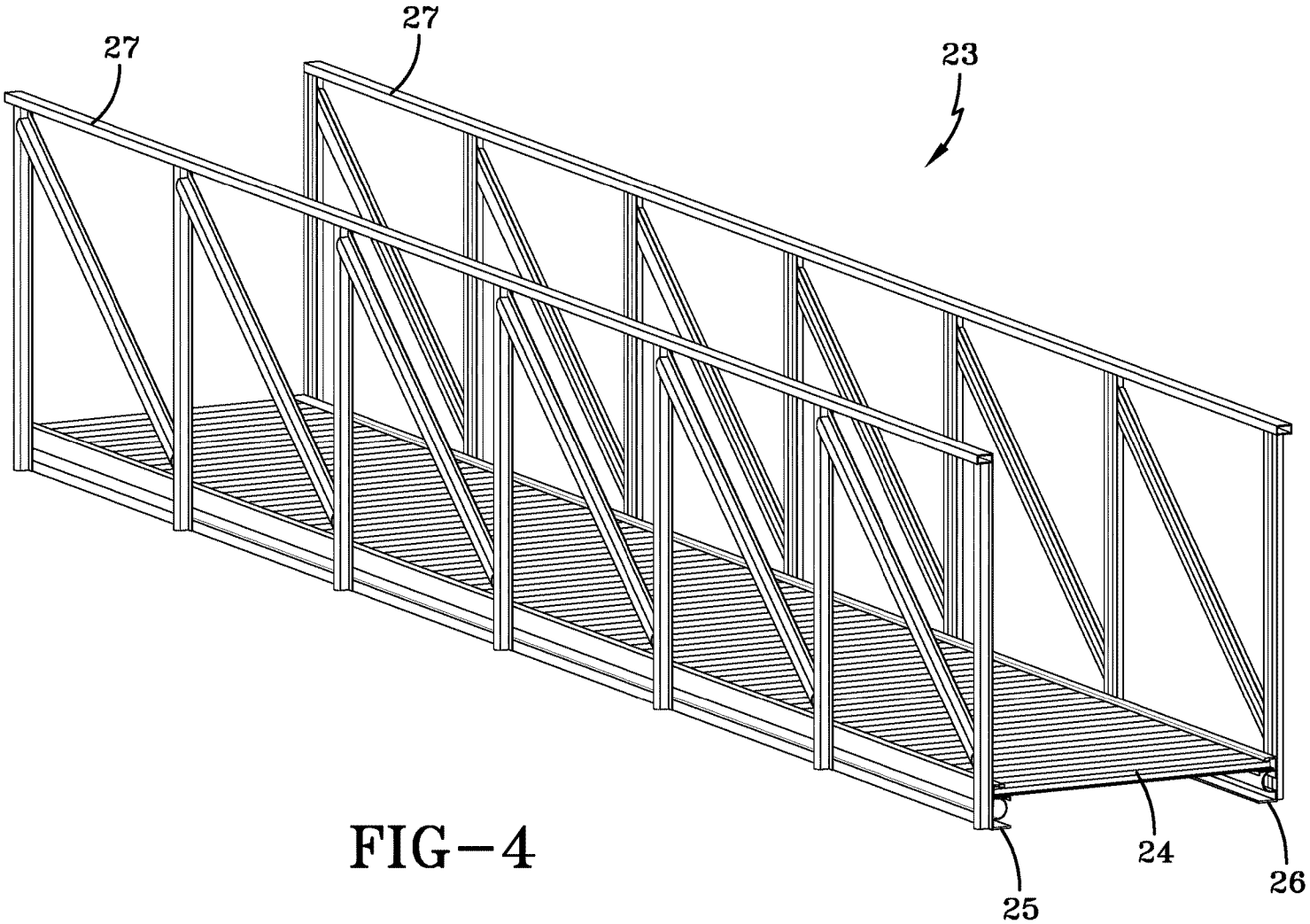
FIG. 4 is a side perspective view of the gangplank of this invention which is equipped with handrails.

The gangplanks 23 of this invention can optionally further include a handrail 25 on one or both sides of the gangplank 23. Handrails 27 are beneficial in that they provide a person crossing over the gangplank 23 with a means to secure their balance and accordingly facilitate safety. In the case of longer gangplanks of about 20 feet in length or longer, such handrails can also provide the gangplank with higher strength and an increased level of stability. Such a gangplank 23 which includes handrails 27 is illustrated in FIG. 3 and FIG. 4.

For purposes of this invention the terms "gangplank" and "gangway" are used interchangeably and should be construed as being the same thing. The gangways and gangplanks of this invention are also intended to cover ramps which can be used to provide passage for people and/or cargo over open areas. For instance, such ramps can be used in loading and unloading trucks at warehouses or to facilitate loading and unloading items onto trucks from ground level (to facilitate the loading of moving trucks). In any case, such ramps can be beneficially used in a wide variety of applications. Such ramps can be hinged only on one end or can be hinged on both ends. In another embodiment of this invention the ramp can be affixed to structures form both ends (in this scenario forming what is essentially a bridge). In a further embodiment of this invention the ramp can be hinged on one end and have a roller on the other end.

While certain representative embodiments and details have been shown for the purpose of illustrating the subject invention, it will be apparent to those skilled in this art that various changes and modifications can be made therein without departing from the scope of the subject invention.

What is claimed is:

1. A side section for a gangplank structure which is comprised of a horizontal base section having an outside end and an inside end, a vertical base section having a top end and a bottom end, wherein the vertical base section extends upwardly from the outside end of the horizontal base section, a horizontal spacer having an outside end and an inside end, wherein the horizontal spacer extends inwardly from the top end of the vertical base section, a sigma spring section which extends upwardly from the inside end of the horizontal spacer in a circumferential manner, a lower deck support having an outside end and an inside end, wherein the lower deck support extends horizontally from the top end of the sigma spring section, and wherein the lower deck support includes a fulcrum which is situated on the top of the lower deck support at a point which is opposite to the point where the lower deck support extends from the sigma spring section, a vertical deck support having a deck engagement section and an outer flange section, wherein the vertical deck support extends from the lower deck support at a point where the deck engagement section meets the outer flange section, and an upper deck support having a cut-away section which extends from the vertical deck support toward the outside of the upper deck support.

2. The side section for the gangplank structure as specified in claim 1 wherein the upper deck support, the lower deck support, and the vertical deck support define a deck engagement cavity, and wherein the deck engagement cavity is adapted for securing a deck therein.

3. The side section for the gangplank structure as specified in claim 1 wherein the side section is comprised of aluminum.

4. The side section for the gangplank structure as specified in claim 1 wherein the sigma spring section extends a distance which is within ±25% of the length of the horizontal base section.

5. The side section for the gangplank structure as specified in claim 1 wherein the side section is further comprised of a handrail which extends upwardly from at least two points along longitudinal axis of the vertical deck support.

6. The side section for the gangplank structure as specified in claim 1 wherein the fulcrum is situated on the lower deck support at a point which is situated about 25% to 45% of the distance from the outside end of lower deck support to the inside end of lower deck support.

7. The side section for the gangplank structure as specified in claim 5 wherein the handrail extends from a point at one longitudinal end of the vertical deck support to a point at the opposite longitudinal end of the vertical deck support.

8. The side section for the gangplank structure as specified in claim 7 the handrail extends from the vertical deck support at a plurality of points along the longitudinal axis of the vertical deck support.

9. A deck structure which is comprised of a first side section, a second side section, and one or more deck sections, wherein the first side section and the second side section are as specified in claim 1 and wherein the deck sections extend from the first side section to the second side section to form the deck structure.

10. The deck structure as specified in claim 9 wherein the deck section extends into the deck engaging cavity of the first side section and wherein the deck section extends into the deck engaging cavity of the second side section.

11. The deck structure as specified in claim 9 wherein the deck sections are comprised of a multitude of planks.

12. The deck structure as specified in claim 9 wherein the deck structure is a gangplank, and wherein the horizontal base section is affixed to a hinge at one end of the deck structure and a roller at the opposite end of the deck structure.

13. The deck structure as specified in claim 9 wherein the deck structure is a floating dock, and wherein the horizontal base section is affixed to one or more float drums on the bottom side of the horizontal base section.

14. The deck structure as specified in claim 9 wherein the deck structure is a stationary dock, and wherein the horizontal base section is affixed to one or more anchoring poles.

15. The deck structure as specified in claim 9 wherein the deck structure is a swim platform, and wherein the horizontal base section is affixed to one or more float drums on the bottom side of the horizontal base section.

16. The deck structure as specified in claim 9 wherein the deck structure is a swim platform, and wherein the horizontal base section is affixed to one or more anchoring poles.

17. A gangway structure which is comprised of a first side section, a second side section, a first end section, a second end section, and one or more deck sections, wherein the first side section and the second side section are as specified in claim 1, wherein the deck sections extend from the first side section to the second side section to form the deck structure, wherein the first end section extends from the first side section to the second side section on a first end of the gangway structure, and wherein the second end section extends from the first side section to the second side section on a second end of the gangway structure.

18. The gangway structure as specified in claim 17 wherein at least one hinge is affixed to the first end of the gangway structure.

19. The gangway structure as specified in claim 18 wherein at least one roller is affixed to the second end of the gangway structure.

20. The gangway structure as specified in claim 18 wherein at least one hinge is affixed to the second end of the gangway structure.

* * * * *